US009328591B2

(12) United States Patent
Peitz

(10) Patent No.: US 9,328,591 B2
(45) Date of Patent: May 3, 2016

(54) AIR RELEASE ASSEMBLY FOR USE WITH PROVIDING HEATED WATER FOR WELL RELATED ACTIVITIES

(71) Applicant: Enservco Corporation, Denver, CO (US)

(72) Inventor: Austin Peitz, Platteville, CO (US)

(73) Assignee: ENSERVCO CORPORATION, Denver, CO (US)

( * ) Notice: Subject to any disclaimer, the term of this patent is extended or adjusted under 35 U.S.C. 154(b) by 471 days.

(21) Appl. No.: 13/834,285

(22) Filed: Mar. 15, 2013

(65) Prior Publication Data

US 2014/0054026 A1 Feb. 27, 2014

Related U.S. Application Data

(60) Provisional application No. 61/692,667, filed on Aug. 23, 2012.

(51) Int. Cl.
*E21B 43/24* (2006.01)

(52) U.S. Cl.
CPC ..... *E21B 43/24* (2013.01); *E21B 43/2405* (2013.01)

(58) Field of Classification Search
None
See application file for complete search history.

(56) References Cited

U.S. PATENT DOCUMENTS

| | | | |
|---|---|---|---|
| 1,522,120 | A | 1/1925 | Halder |
| 1,527,740 | A | 2/1925 | Lipshitz |
| 1,886,448 | A | 11/1932 | Calvin |
| 2,065,789 | A | 12/1936 | Bolsinger |
| 2,122,900 | A | 7/1938 | Uhrmacher |
| 2,395,258 | A | 2/1946 | Drake |
| 2,410,900 | A | 11/1946 | Radbill |
| 2,631,017 | A | 3/1953 | Gibson et al. |
| 2,645,463 | A | 7/1953 | Stearns |
| 2,486,141 | A | 10/1953 | Follo |
| 2,969,451 | A | 5/1958 | Logan |
| 2,892,509 | A | 6/1959 | Baker et al. |
| 2,922,441 | A | 1/1960 | Klute |
| 3,106,915 | A | 10/1963 | Key, Jr. |
| 3,232,336 | A | 2/1966 | Leslie et al. |
| 3,379,250 | A | 4/1968 | Matthews et al. |
| 3,411,571 | A | 11/1968 | Lawrence |
| 3,421,583 | A | 1/1969 | Koons |

(Continued)

FOREIGN PATENT DOCUMENTS

| | | |
|---|---|---|
| CA | 1301639 | 5/1992 |
| CA | 2792323 | 4/2014 |

(Continued)

OTHER PUBLICATIONS

Armstrong International, Flo-Rite-Temp Bulletin No. AY-408-H, dated May 2002.

(Continued)

*Primary Examiner* — Giovanna C Wright
(74) *Attorney, Agent, or Firm* — Fox Rothschild LLP

(57) ABSTRACT

A system is provided that allows relatively low temperature water to be withdrawn from a pipeline for heating and then returning the heated water to the pipeline, wherein the assembly includes a device for limiting or preventing excess air within the pipeline to also be drawn into the one or more water heaters being used. At least one embodiment further includes a device for adjusting the rate of flow through a primary pipe so that desired temperatures are maintained during the heating process.

16 Claims, 8 Drawing Sheets

(56) References Cited

U.S. PATENT DOCUMENTS

| | | | | |
|---|---|---|---|---|
| 3,454,095 | A | 7/1969 | Messenger et al. | |
| 3,572,437 | A | 3/1971 | Marberry et al. | |
| 3,581,822 | A | 6/1971 | Cornelius | |
| 3,670,807 | A | 6/1972 | Muller | |
| 3,685,542 | A | 8/1972 | Daughirda | |
| 3,698,430 | A | 10/1972 | Van Gasselt et al. | |
| 3,768,257 | A | 10/1973 | Neuffer | |
| 3,816,151 | A | 6/1974 | Podlas | |
| 3,938,594 | A | 2/1976 | Rhudy et al. | |
| 3,980,136 | A | 9/1976 | Plummer et al. | |
| 3,982,910 | A | 9/1976 | Houseman et al. | |
| 4,044,727 | A | 8/1977 | Rychen et al. | |
| 4,076,628 | A | 2/1978 | Clampitt | |
| 4,137,182 | A | 1/1979 | Golinkin | |
| 4,175,697 | A | 11/1979 | Dreibelbis | |
| 4,518,568 | A | 5/1985 | Shannon | |
| 4,574,775 | A | 3/1986 | Lutzen et al. | |
| 4,658,803 | A | 4/1987 | Ball et al. | |
| 4,753,220 | A | 6/1988 | Lutzen et al. | |
| 4,807,701 | A | 2/1989 | Hall et al. | |
| 4,830,111 | A | 5/1989 | Jenkins | |
| 4,966,100 | A | 10/1990 | Fournier et al. | |
| 5,018,396 | A | 5/1991 | Penny | |
| 5,038,853 | A | 8/1991 | Callaway, Sr. et al. | |
| 5,183,029 | A | 2/1993 | Ranger | |
| 5,445,181 | A | 8/1995 | Kuhn et al. | |
| 5,467,799 | A | 11/1995 | Buccicone et al. | |
| 5,494,077 | A | 2/1996 | Enoki et al. | |
| 5,520,165 | A | 5/1996 | Khinkis et al. | |
| 5,551,630 | A | 9/1996 | Enoki et al. | |
| 5,586,720 | A | 12/1996 | Spiegel et al. | |
| 5,588,088 | A | 12/1996 | Flaman | |
| 5,623,990 | A | 4/1997 | Pirkle | |
| 5,656,136 | A | 8/1997 | Gayaut et al. | |
| 5,765,546 | A | 6/1998 | Mandeville et al. | |
| 5,875,843 | A | 3/1999 | Hill | |
| 5,893,341 | A | 4/1999 | Cox | |
| 5,924,391 | A | 7/1999 | Baker et al. | |
| 5,979,549 | A | 11/1999 | Meeks | |
| 6,024,290 | A | 2/2000 | Dosani et al. | |
| 6,470,836 | B1 | 10/2002 | Manley et al. | |
| 6,776,153 | B1 | 8/2004 | Walker et al. | |
| 7,298,968 | B1 | 11/2007 | Boros et al. | |
| 7,477,836 | B2 | 1/2009 | White, III | |
| 7,744,007 | B2 | 6/2010 | Beagen et al. | |
| 8,044,000 | B2 | 10/2011 | Sullivan et al. | |
| 8,171,993 | B2 | 5/2012 | Hefley | |
| 8,286,595 | B2 | 10/2012 | Cerney et al. | |
| 8,312,924 | B2 | 11/2012 | Smith | |
| 8,534,235 | B2 | 9/2013 | Chandler | |
| 8,567,352 | B2 | 10/2013 | Kaupp | |
| 8,739,875 | B2 | 6/2014 | Hefley | |
| 8,905,138 | B2 | 12/2014 | Lundstedt | |
| 2002/0052298 | A1 | 5/2002 | Chowdhary | |
| 2005/0023222 | A1* | 2/2005 | Baillie | B01D 61/04 210/651 |
| 2006/0090798 | A1 | 5/2006 | Beagen et al. | |
| 2007/0170273 | A1 | 7/2007 | McIllwain | |
| 2008/0029267 | A1 | 2/2008 | Shampine et al. | |
| 2009/0023614 | A1 | 1/2009 | Sullivan et al. | |
| 2009/0056645 | A1 | 3/2009 | Hobbs et al. | |
| 2009/0060659 | A1 | 3/2009 | Wallace | |
| 2009/0308613 | A1 | 12/2009 | Smith | |
| 2010/0000508 | A1 | 1/2010 | Chandler | |
| 2010/0031506 | A1 | 2/2010 | Hartwig et al. | |
| 2010/0294494 | A1* | 11/2010 | Hefley | E21B 43/26 166/272.2 |
| 2013/0145996 | A1 | 6/2013 | Cooper et al. | |
| 2013/0312972 | A1 | 11/2013 | Lundstedt et al. | |
| 2014/0026824 | A1 | 1/2014 | Romocki | |
| 2014/0027386 | A1 | 1/2014 | Munisteri | |
| 2014/0083408 | A1 | 3/2014 | Berg et al. | |
| 2014/0144393 | A1 | 5/2014 | Chandler | |
| 2014/0144394 | A1 | 5/2014 | Chandler | |
| 2014/0144641 | A1 | 5/2014 | Chandler | |

FOREIGN PATENT DOCUMENTS

| | | |
|---|---|---|
| DE | 2814886 | 10/1979 |
| EP | 0767347 | 4/1997 |
| JP | 2911989 | 6/1999 |
| SU | 1672110 | 8/1991 |
| WO | 2010/018356 | 2/2010 |
| WO | 2011/034679 | 3/2011 |
| WO | 2013/067138 | 5/2013 |
| WO | 2013/148342 | 10/2013 |

OTHER PUBLICATIONS

Bradley et al., "Thermal Degradation of Guar Gum," Carbohydrate Polymers, 1989, vol. 10, pp. 205-214.

Cassinat et al., "Optimizing Waterfllod Performance by Utilizing Hot Water Injectino in a High Parafin Content Reservoir," SPE/DOE Improved Recovery Symposium, Apr. 13-17, 2002, Tulsa, OK, SPE 75141.

McShan, J., "SPD18 Oil-Fired Frac Water Heating Unit Primary and Secondary Combustion Air System" Chandler Mfg. Inc., 2008.

Consulting Agency Trade (C.A.T.) GmbH, "Hydration Unit mixing unit for preparation fracturing fluids," dated Mar. 2008.

Crawford, M., "Technology in the Service Sector Water Super-Heating Technology Slashes Energy Costs," (available at http://www.wellservicingmagazine.com/featured-articles/2012/11/technology-in-the-service-sector-water-super-heating-technology-slashes-energy-costs/), dated 2012.

HPAC webpage "Optimizing the Performance of Radiant Heating Systems," (http://hpac.com/heating/optimizing-performance-radiant-heating-systems), dated Jul. 1, 2008.

Kirilov, et al., "A New Hydraulic Fracturing Package Fit for Artic Conditions Improves Operational Effciency and Fracture Conductivity and Enhances Production in Western Siberia," 2006 SPE Russian Oil and Gas Technical Conference and Exhibition, Oct. 3-6, 2006, Moscow, Russia, SPE102623.

Komax HotShot™ Inline Steam Heater (web archive: http://komax.com/products/inline_steam_heater.html) dated Apr. 20, 2008.

Schumacher et al., "Subzero Hydraulic Fracturing: A Field Case Study, Lisburne Carbonate Reservoir, Prudhoe Bay Unit, North Slope, Alaska," 56th California Regional Meeting of the Society of Petroleum Engineers, Apr. 2-4, 1986, Oakland, CA, SPE 15068.

Chan, Keng Seng et al., "Oilfield Chemistry at Thermal Extremes," Oilfield Review, (Autumn 2006), pp. 4-17.

PSNC Energy "Commercial and Industrial Facilities Go 'Tankless,'" available on the internet at least as early as Nov. 18, 2006, Internet Archive Wayback Machine, http://web.archive.org/web/20061118194825/http://www.psncenergy.com/en/small-to-medium-business/business-sectors/hospitality/commercial-industrial-facilities-go-tankless.htm.

Webpage describing Firestorm™ Direct-Contact Water Heaters, captured on May 11, 2008 by the Internet Archive, available at brochure http://web.archive.org/web.20080511165612/http://heatec.com/products_concrete/firestorm/firestorm.htm.

Zughbi, Habib D. et al., "Mixing in Pipelines with Side and Opposed Tees," Ind. Eng. Chem. Res., American Chemical Society, (2003), 42 (21), pp. 5333-5334 (Abstract only).

Austin Peitz Statement signed Feb. 5, 2016 with Transcript of Rule 30(b)(6) Deposition of Heat Waves Hot Oil Service, LLC, Austin Peitz, dated Oct. 23, 2014, U.S. District Court for North Dakota, Case No. 4:13-cv-010-DLH-CSM, with Exhibits.

* cited by examiner

AIR RELEASE ASSEMBLY FOR USE WITH PROVIDING HEATED WATER FOR WELL RELATED ACTIVITIES

CROSS-REFERENCE TO RELATED APPLICATION

The present application claims the benefit of U.S. Provisional Patent Application No. 61/692,667 filed on Aug. 23, 2012, the entire contents of which are incorporated herein by reference in its entirety.

FIELD

The present invention is related to a method and apparatus for providing heated water, such as providing heated water for oil and gas well related activities.

BACKGROUND

Various activities are performed on oil and gas wells to improve the performance characteristics of the wells. By way of example, as part of a hydraulic fracturing process, water is heated and is used in the hydraulic fracturing procedure. However, there is a need for additional methods and devices that improve the withdrawal of low temperature water from a pipeline and return of heated water to the pipeline.

As those skilled in the art will appreciate, a source of water at a hydraulic fracturing project site may take several different forms. For example, a plurality of water storage tanks, such as tanker truck tanks filled with water, may be used as a source of water at a given hydraulic fracturing project site. When being used, water is removed from the tanks, such as by pumping the water from the tanks. As water is pumped from a given tank, the water level is drawn down within the tank, and at times, air is drawn into the water line. If multiple water tanks are being used, such as tens or even hundreds of water tanks, successive injections of air into a water line can occur.

The presence of air within the water line can be a safety issue for workers and it can also cause damage to equipment. For example, as air is pumped within the water line, it can cause pipe and/or hose connections to vibrate or even come loose, thereby potentially causing a physical hazard to a nearby worker. With regard to equipment, not only are fittings sometimes stressed or damaged, but air within the pipeline can create a situation where steam is generated in the heating process that is used to heat the water. The generation of steam can lead to detrimental effects on the integrity of coils within the water heating system, such as rupturing coils that could injure workers. Accordingly, it would be advantageous to maintain circulation within the heating coils by limiting or preventing the presence of air within a water heating system forming part of a hydraulic fracturing system.

SUMMARY

It is to be understood that the present invention includes a variety of different versions or embodiments, and this Summary is not meant to be limiting or all-inclusive. This Summary provides some general descriptions of some of the embodiments, but may also include some more specific descriptions of other embodiments.

In at least one embodiment, a pipe configuration is provided that allows relatively low temperature water to be withdrawn from a pipeline, heated and then returned to the pipeline. At least one embodiment includes an assembly of elements that allows air within a flow of water in a pipe to be removed from the pipe before the water is heated and returned to the pipe. In at least one embodiment, removal of the air from the water within a pipe may be performed prior to or in association with conveyance of the water through a device for adjusting the rate of flow through a primary pipe so that desired temperatures are maintained during the heating process.

Accordingly, an assembly adapted for use with an oil/gas well treatment system that includes a water source (e.g., a plurality of mobile, truck transportable water tanks filled with water) and upstream piping carrying a primary flow of water from the water source is provided, the oil/gas well treatment system further including one or more water heaters (e.g., at least one mobile, truck mounted/transportable heating unit) for heating a partial flow from the primary flow of water, the oil/gas well treatment system further including downstream piping, the assembly comprising:

a primary pipe for coupling to the upstream piping and the downstream piping;

a lateral outlet pipe (or hose) connected to the primary pipe for conveying the partial flow from the primary flow of water from the primary pipe;

an air release structure connected to the lateral outlet pipe, the air release structure adapted to release at least some air within the partial flow from the primary flow of water;

a transfer pipe (or hose) located between the air release structure and the one or more water heaters, the transfer pipe adapted for conveying water between the air release structure and the one or more water heaters; and a lateral inlet pipe (or hose) connected to the primary pipe, the lateral inlet pipe interconnected to the air release structure via the one or more water heaters and the transfer pipe.

In accordance with at least one embodiment, an inlet for the lateral outlet pipe entering the air release structure is located at a higher elevation than an outlet for the transfer pipe exiting the air release structure. In at least one embodiment, multiple air release structures may be used where they are fluidly interconnected. Alternatively, if multiple water heaters are used, then a separate air release structure may be associated upstream of each water heater, such that each water heater is drawing water from an air release structure.

One or more embodiments described herein are directed to a device for controlling a flow of water associated with a water heating system. Accordingly, a diverting and restricting apparatus for adjusting a water flow in an oil/gas well treatment system that includes one or more water heaters is provided, the system having a water source with upstream piping, the system having downstream piping, the diverting and restricting apparatus comprising:

a primary pipe for coupling to the upstream piping and the downstream piping;

a lateral outlet pipe connected to the primary pipe;

a lateral inlet pipe connected to the primary pipe, the lateral inlet pipe fluidly interconnected to the lateral outlet pipe via the one or more water heaters; and a valve situated within the primary pipe and located between a location of the lateral outlet pipe and the lateral inlet pipe.

In at least one embodiment, the valve comprises a butterfly valve. In at least one embodiment, the valve is manually actuated. In at least one embodiment, the valve is electronically actuated. In at least one embodiment, the system further comprises a temperature gauge operatively associated with the primary pipe for sensing a temperature within the primary pipe. In at least one embodiment, a computer monitors readings from the temperature gauge and adjusts the valve. In at least one embodiment, the system further comprises at least one secondary valve operatively associated with at least one of the lateral outlet pipe and the lateral inlet pipe. In at least one embodiment, the at least one secondary valve comprises a butterfly valve. In at least one embodiment, the at least one secondary valve is manually actuated. In at least one embodiment, the at least one secondary valve is electronically actuated. In at least one embodiment, a computer monitors readings from a temperature gauge and adjusts the at least one secondary valve. In at least one embodiment, the system further comprises a temperature gauge downstream of the primary pipe and is operatively associated with a liquid storage member. In at least one embodiment, the liquid storage member comprises one or more of a tank, container, pond, and liquid holding apparatus.

In another embodiment, a diverting and restricting apparatus for adjusting a water flow in an oil/gas well treatment system is provided, the system having a water source with upstream piping, the system having downstream piping, the diverting and restricting apparatus comprising:

a primary pipe for coupling to the upstream piping and the downstream piping;

a lateral outlet pipe connected to the primary pipe and extending to one or more water heaters;

a lateral inlet pipe connected to the primary pipe, the lateral inlet pipe fluidly interconnected to the lateral outlet pipe via the one or more water heaters;

a valve situated within the primary pipe and located between a location of the lateral outlet pipe and the lateral inlet pipe;

at least one secondary valve operatively associated with at least one of the lateral outlet pipe and the lateral inlet pipe; and a temperature gauge operatively associated with the primary pipe for sensing a temperature within the primary pipe.

In yet another embodiment, a diverting and restricting apparatus for adjusting a water flow in an oil/gas well treatment system is provided, the system having a water source with upstream piping, the system having downstream piping, the diverting and restricting apparatus comprising:

a primary pipe for coupling to the upstream piping and the downstream piping;

a lateral outlet pipe connected to the primary pipe and extending to one or more water heaters;

a lateral inlet pipe connected to the primary pipe, the lateral inlet pipe fluidly interconnected to the lateral outlet pipe via the one or more water heaters;

a flow restriction apparatus situated within the primary pipe and located between a location of the lateral outlet pipe and the lateral inlet pipe; and a temperature gauge operatively associated with the primary pipe for sensing a temperature within the primary pipe.

In at least one embodiment, the flow restriction apparatus comprises a valve, such as a butterfly valve. In at least one embodiment, a computer wirelessly monitors readings from the temperature gauge and adjusts the butterfly valve.

Various components are referred to herein as "operably associated." As used herein, "operably associated" refers to components that are linked together in operable fashion, and encompasses embodiments in which components are linked directly, as well as embodiments in which additional components are placed between the two linked components.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, a more particular description of the one or more present inventions is rendered by reference to specific embodiments thereof which are illustrated in the appended drawings. It should be appreciated that these drawings depict only typical embodiments of the one or more present inventions and are therefore not to be considered limiting of its scope. The one or more present inventions are described and explained with additional specificity and detail through the use of the accompanying drawings in which.

The drawings are not necessarily to scale.

DETAILED DESCRIPTION

One or more embodiments of the one or more present inventions described herein include a system for heating water (or other liquid) for an oil and gas well system and returning the heated water to a conveyance pipe. Accordingly, in at least one embodiment, an apparatus is provided for passing water, withdrawing water, and adding water to a flow of water to thereby provide a stream of water at a suitable temperature. In at least one embodiment, an air release structure is provided for limiting or preventing air from being transmitted to the one or more water heaters being used to heat the water.

Figure 1:
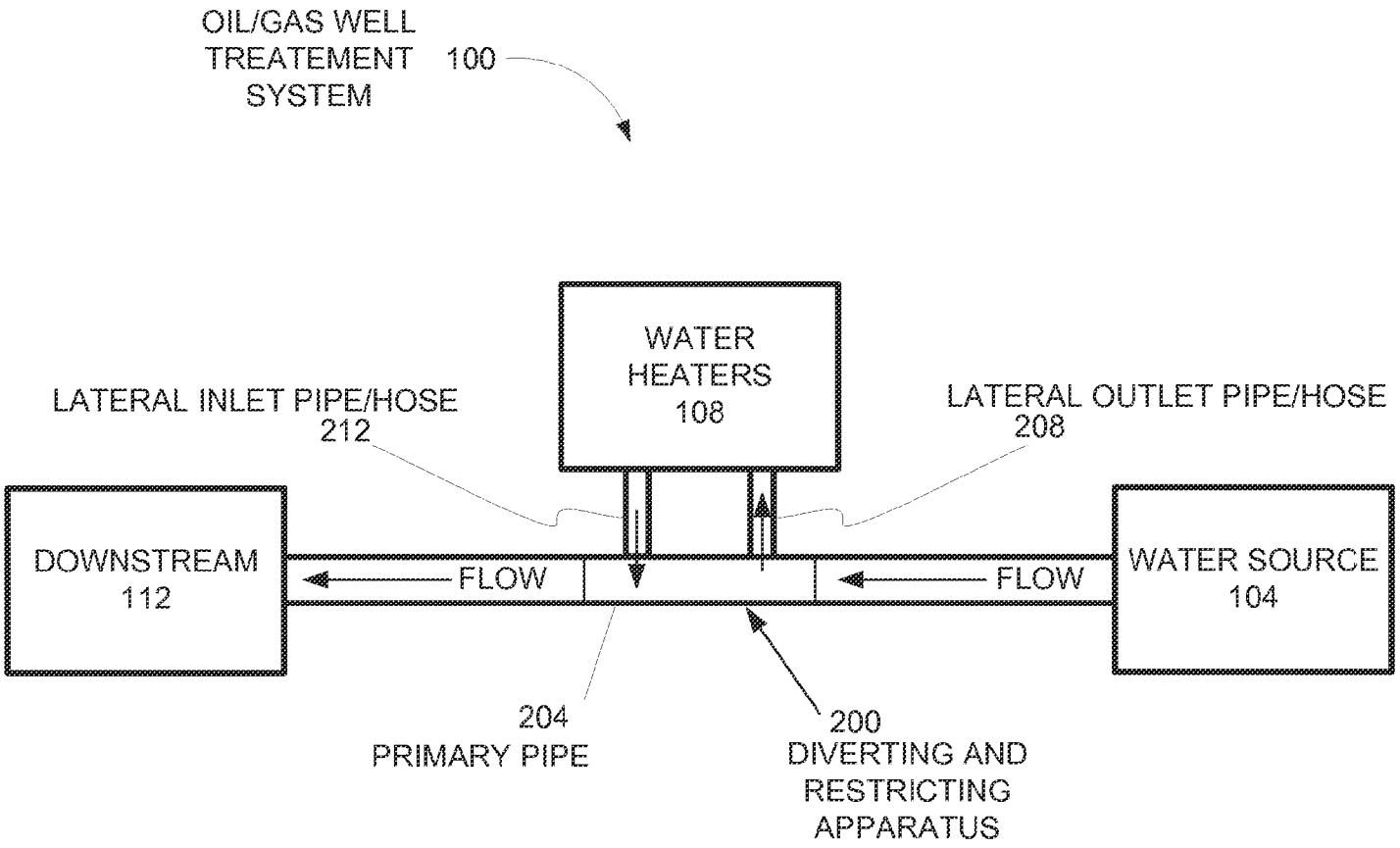
FIG. 1 is a schematic of a system in accordance with an embodiment of the one or more present inventions.

Referring now to FIG. 1, an overall schematic of a portion of the oil/gas well treatment system 100 is shown. Here, it is to be understood that an oil/gas well treatment system is used as an example, and is not be interpreted as limiting the uses of the technology. For example, the system and methods described herein are applicable to other systems requiring heated liquids, including liquids other than water, such as water with additives and oil. Within the oil and gas well industry, embodiments described herein are at least applicable to heating liquids, such as water, used in hydraulic fracturing of a subsurface geologic formation that is expected to contain oil and/or gas.

As shown in FIG. 1, an upstream water source 104 is fluidly connected by piping to diverting and restricting apparatus 200. The diverting and restricting apparatus 200 includes a primary pipe 204 and one or more lateral outlet pipes 208 that carry water to one or more water heaters 108. As used herein, pipe or piping (including primary and lateral pipes) includes liquid conveyance devices or conduits of a variety of material types (e.g., metal, plastic, rubber, fabric, composites, and ceramic), and further include hose, tubing and the like, as well as combinations of the foregoing. Heated water is returned from the one or more water heaters 108 to the diverting and restricting apparatus 200 via one or more lateral inlet pipes 212. Thereafter, the flow of water is conveyed downstream. By way of example and not limitation, downstream elements may include one or more liquid storage members, such as one or more of a tank, container, vessel, pond (e.g., membrane lined pond) or combinations of the like for storing heated water until it is used.

Figure 2:
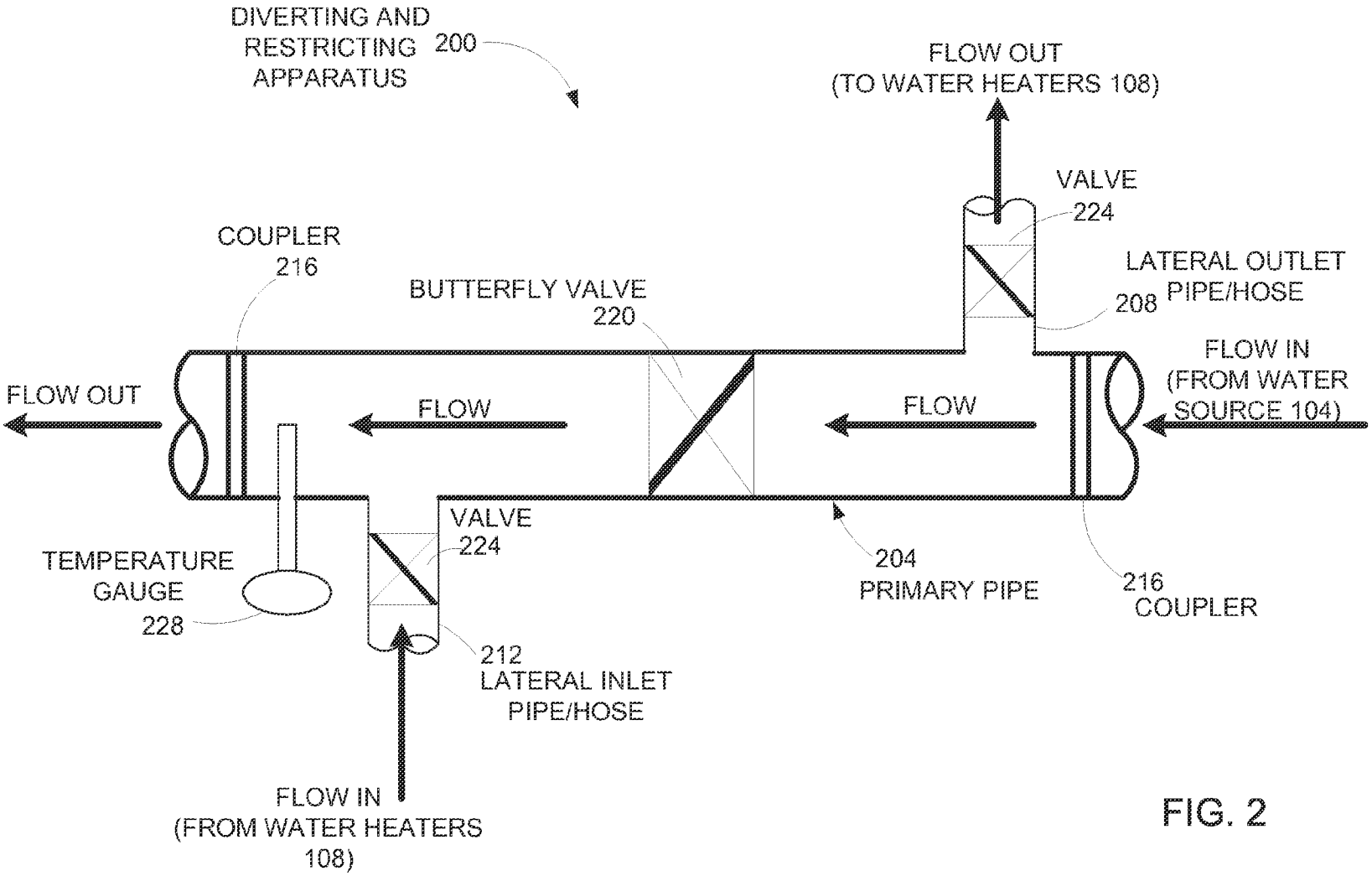
FIG. 2 is a schematic of an embodiment of the diverting and restricting apparatus portion of the system depicted in FIG. 1.

Referring now to FIG. 2, an embodiment of a diverting and restricting apparatus 200 is shown. The diverting and restricting apparatus 200 includes an upstream flange or coupler 216 for interconnecting the diverting and restricting apparatus 200 to an upstream pipe that is fluidly connected to the water source 104. As noted above, the diverting and restricting apparatus 200 further includes a primary pipe 204 having at least one lateral outlet pipe 208. The lateral outlet pipe 208 provides a way of withdrawing a portion of the flow from the primary pipe 204 that can be conveyed to one or more portable heating units 108 for heating. After heating water at the one or more portable heating units 108, the heated water is returned to the primary pipe 204 via at least one lateral inlet pipe 212. The lateral inlet pipe 212 is located downstream of the lateral outlet pipe 208.

As those skilled in the art will appreciate, connections between different sections of pipe may take a variety of forms. In at least one embodiment, the lateral outlet pipe 208 and lateral inlet pipe 212 are connected to the primary pipe 204 by welded connections; however, other types of connections and/or fittings may be used as known to those skilled in the art. In addition, in at least one embodiment, hose is used in combination with metal pipe that are interconnected via a coupling, and such combinations of materials can be used to provide fluid conduit between the primary pipe 204 and the one or more portable heating units 108. Accordingly, the description provided herein is to be considered exemplary, with pipe (to include hose, conduit and the like) connections generally referred to herein simply as "connected."

In at least one embodiment, a primary flow control mechanism 220, such as a valve, and more preferably a butterfly valve, is located in the flow path of the primary pipe 204 between lateral outlet pipe 208 and the lateral inlet pipe 212. The primary flow control mechanism 220 allows the overall rate of flow through the primary pipe 204 to be adjusted. In at least one embodiment, a secondary flow control mechanism 224, such as a valve, and more preferably a butterfly valve, can be used to adjust the rate of flow passing through the lateral outlet pipe 208. Similarly, a secondary flow control mechanism 224, again, such as a valve, and more preferably a butterfly valve, can be used to adjust the rate of flow passing through the lateral inlet pipe 212 and entering primary pipe 204.

In at least one embodiment, a temperature gauge 228 is located downstream of the lateral inlet pipe 212. The temperature gauge 228 preferably includes a sensor for measuring the temperature of the water passing through the primary pipe 204 at the location of the temperature gauge 228. As those skilled in the art will appreciate, depending upon the temperature of the water measured at the temperature gauge 228, aspects of the diverting and restricting apparatus 200 can be adjusted to accommodate the desired flow rate and water temperature. By way of example, the primary flow control mechanism 220 can be adjusted to increase the water flow in the primary pipe 204 if the temperature is too high. Similarly, the primary flow control mechanism 220 can be adjusted to decrease the water flow in the primary pipe 204 if the temperature is too low. Alternatively, the secondary flow control mechanisms 224 can be adjusted to increase or decrease the flow rate of water to and from the water heaters 108 depending upon the desired temperature and flow rate requirements for a given project or portion thereof. As those skilled in the art will appreciate, the ability to adjust the flow rates of the primary pipe and one or more of the lateral outlet or lateral inlet pipes can be further influenced by the temperature of the water available from the water source. For example, a water source at a first project site at northern latitudes with well treatment operations being conducted in winter may have lower temperatures for its water source as compared to higher water temperatures for a water source at a second project site situated in warmer latitudes with well treatment operations being conducted in the summer. Accordingly, the diverting and restricting apparatus 200 includes a combination of features that permits personnel working on a project to adjust the diverting and restricting apparatus to accommodate the needs of the project as they change.

Figure 3:
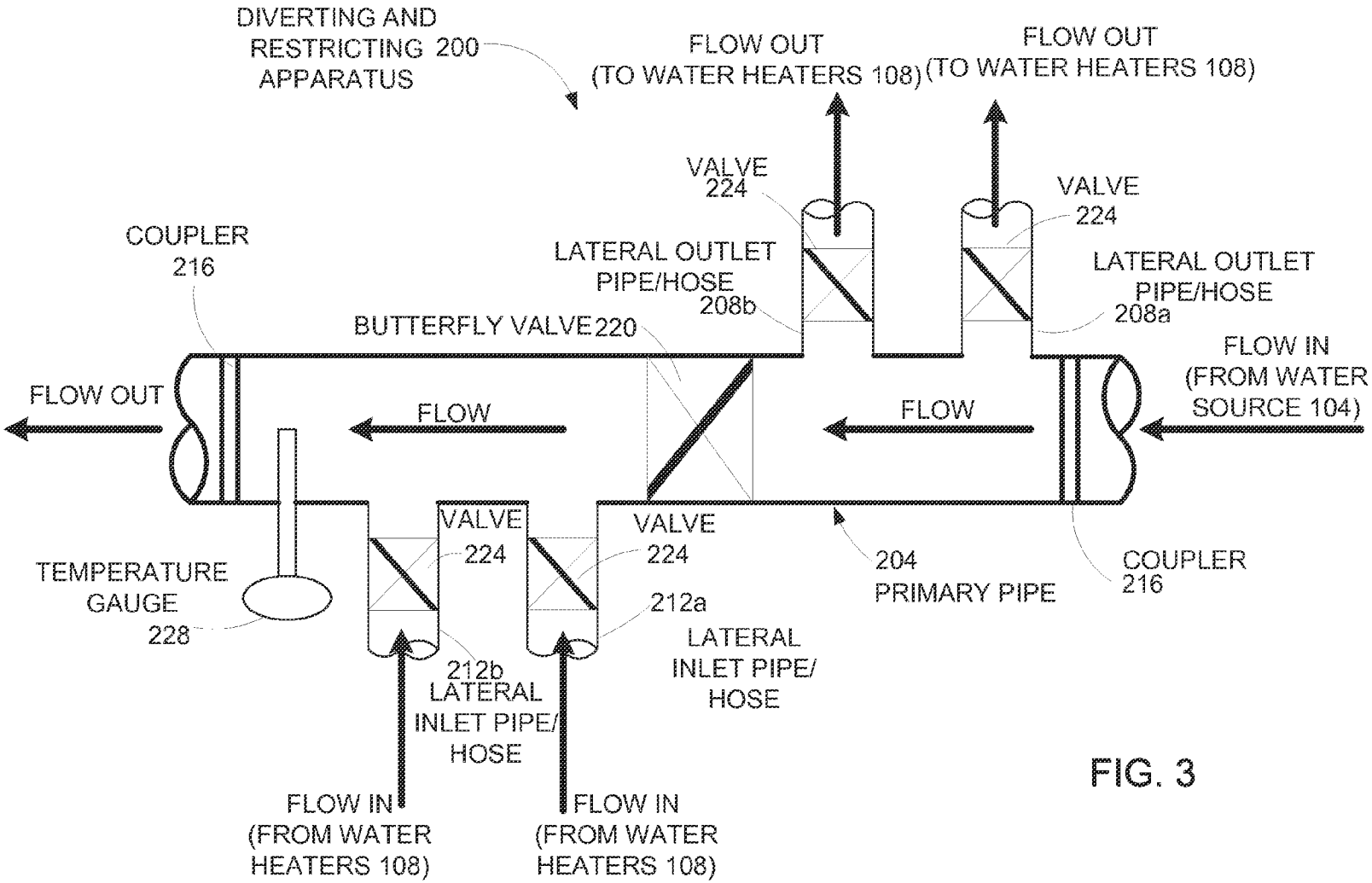
FIG. 3 is another schematic of an embodiment of the diverting and restricting apparatus portion of the system depicted in FIG. 1.

With reference now to FIG. 3, a diverting and restricting apparatus 200 is depicted that includes a plurality of lateral outlet pipes. Although two lateral outlet pipes are shown, it is to be understood that any number of lateral outlet pipes could be used, such as 2 to 100 lateral outlet pipes depending upon the project. A similar number of lateral inlet pipes may also be used. Referring still to FIG. 3, two lateral outlet pipes are shown, namely, first lateral outlet pipe 208*a* and second lateral outlet pipe 208*b*. In addition, two lateral inlet pipes are shown, namely, first lateral inlet pipe 212*a* and second lateral inlet pipe 212*b*.

In use, unheated water flows from the water source 104 to the diverting and restricting apparatus 200 where a portion of the flow is conveyed through one or more lateral outlet pipes 208 to the water heaters 108. Water is heated and returned to the primary pipe 204 of the diverting and restricting apparatus 200 via one or more lateral inlet pipes 212. The temperature of the flow of water through the diverting and restricting apparatus 200 is monitored at temperature gauge 228. The primary flow control mechanism 220 can be used to adjust the flow, and thus the temperature of water passing through the diverting and restricting apparatus 200. In addition, more or less flow can be sent to the water heaters 108 by adjusting the flow of water using the secondary flow control mechanisms 224. Of course, the water heaters 108 may also be adjusted to increase the temperature of the water they receive as conditions warrant. Such a configuration enables a substantially continuous flow of water to be provided downstream within the desired flow rate and temperature parameters.

In at least one embodiment, a computer and related controls (to include, by way of example and not limitation, one or more of microprocessor, discrete circuit connected to step motors and analog circuits) is used to adjust the flow, and thus the temperature, of water passing through the diverting and restricting apparatus 200. More specifically, as one possible algorithm, electronic signals from a temperature gauge 228 are received at a computer, wherein the electronic signals correspond to temperature readings measured by the temperature gauge 228. The computer compares the temperature readings to an established target value for the temperature of the heated water, and thereafter, causes one or more adjustments to be made to the system, such as by sending an electronic signal to the primary flow control mechanism 220 to partially open or partially close. So for example, after comparing the temperature reading to the target value, if the computer determines that the temperature is too low, the computer then sends an electronic signal to the primary flow control mechanism 220 to partially close. Conversely, if after comparing the temperature reading to the target value the computer determines that the temperature is too high, the flow rate through the primary pipe 204 can be increased by partially opening the primary flow control mechanism 220 (provided it is not already fully open). In addition, if the computer determines that the temperature is within an acceptable tolerance of the established target temperature, then the computer will not send an electronic signal causing an adjustment to be made to primary flow control mechanism 220. The algorithm further includes looping back to receiving a temperature reading and performing another comparison and so on until such time as the water heating process is terminated.

The computer can also be used to adjust one or more of the secondary flow control mechanisms 224. More particularly, rather than only adjust the flow through the primary pipe 204, after comparing the temperature reading to the targeted value, the computer can send electronic signals to the one or more of the secondary flow control mechanisms 224 to partially open or close. So for example, after comparing the temperature reading to the target value, if the computer determines that the temperature is too low, the computer then sends an electronic signal to the secondary flow control mechanism 224 associated with a lateral outlet pipe 208 that leads to one or more of the portable water heaters 108 to partially open. Conversely, if after comparing the temperature reading to the target value the computer determines that the temperature is too high, the flow rate through the lateral outlet pipe 208 can be decreased by partially closing the associated secondary flow control mechanism 224. Adjustments could also be made to the secondary flow control mechanisms 224 associated with the lateral inlet pipes 212. Again, if the computer determines that the temperature is within an acceptable tolerance of the established target temperature, then the computer will not send an electronic signal causing an adjustment to be made to a secondary primary flow control mechanism 224. The algorithm further includes looping back to receiving a temperature reading and performing another comparison and so on until such time as the water heating process is terminated.

Moreover, the computer can also be used to simultaneously adjust both the primary flow control mechanism 220 and the secondary flow control mechanisms 224 associated with one or more of the lateral outlet pipes 208 and the lateral inlet pipes 212, as may be desired.

Data can be transmitted between the computer and the temperature gauge 228, as well as the primary flow control mechanism 220 and the secondary flow control mechanisms 224, via wiring or via wireless communications, such as radio frequency signals.

As those skilled in the art will appreciate, it is possible to adjust a flow rate of a liquid in a pipe by adjusting a pumping rate of the liquid entering the pipe. Alternatively, it may be desirable to not adjust the pumping rate (for example, because pumps belong to a different entity). Accordingly, in at least one embodiment, the temperature of a flow of liquid is monitored at a temperature sensor, and a flow of liquid is adjusted only by controlling a flow restrictor (such as a butterfly valve) in a primary pipe between at least one lateral outlet pipe and one lateral inlet pipe, wherein a pump is not adjusted, at least for a period of time associated with heating liquid, to control the flow of liquid. In at least one embodiment the liquid is selected from the group consisting of water, oil, chemical additives, and combinations thereof.

For the one or more embodiments utilizing a computer, the systems and methods of this technology can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, any comparable means, or the like. In general, any device(s) or means capable of implementing the methodology illustrated herein can be used to implement the various aspects of this technology.

Exemplary hardware that can be used for the present system includes computers, handheld devices and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this technology is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a computer readable storage medium, executed on a programmed general-purpose computer with the cooperation of a controller and memory, a special purpose computer, a microprocessor, or the like. In these instances, the systems and methods of this technology can be implemented as a program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Figure 4:
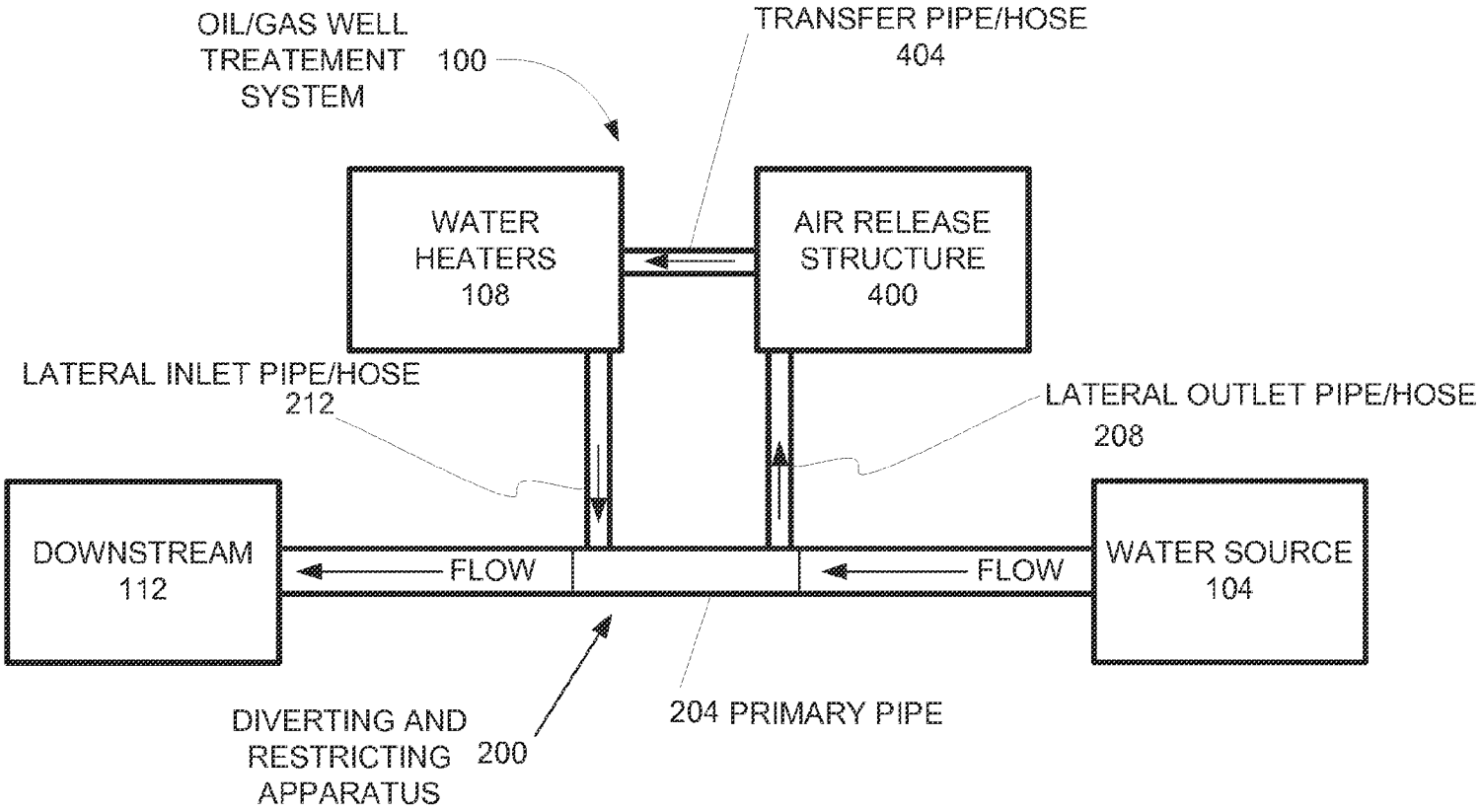
FIG. 4 is a schematic of a system in accordance with another embodiment of the one or more present inventions, the system including an air release structure upstream of the one or more water heaters.

Referring now to FIG. 4, and in a further embodiment of the one or more inventions described herein, an oil/gas well treatment system 100 is provided that includes an air release structure 400. The air release structure 400 is a container or portion thereof suitable for holding water or another liquid. The air release structure 400 preferably includes an air release vent to release air to the atmosphere. When comparing FIG. 4 to FIG. 1, it can be seen that, in one embodiment, the air release structure 400 is situated between the lateral outlet pipe 208 and the one or more water heaters 108. Therefore, the air release structure 400 enables air to be removed from that portion of the water flow that is being heated and returned to the primary pipe 204. In at least one embodiment, if multiple water heaters are used, then a separate air release structure may be associated upstream of each water heater, such that each water heater is drawing water from an air release structure. Alternatively, if a sufficiently large air release structure is used, then it may be interconnected to a plurality of water heaters. In addition, in at least one embodiment a transfer pipe 404 is located between the air release structure 400 and the one or more water heaters 108.

Figure 5:
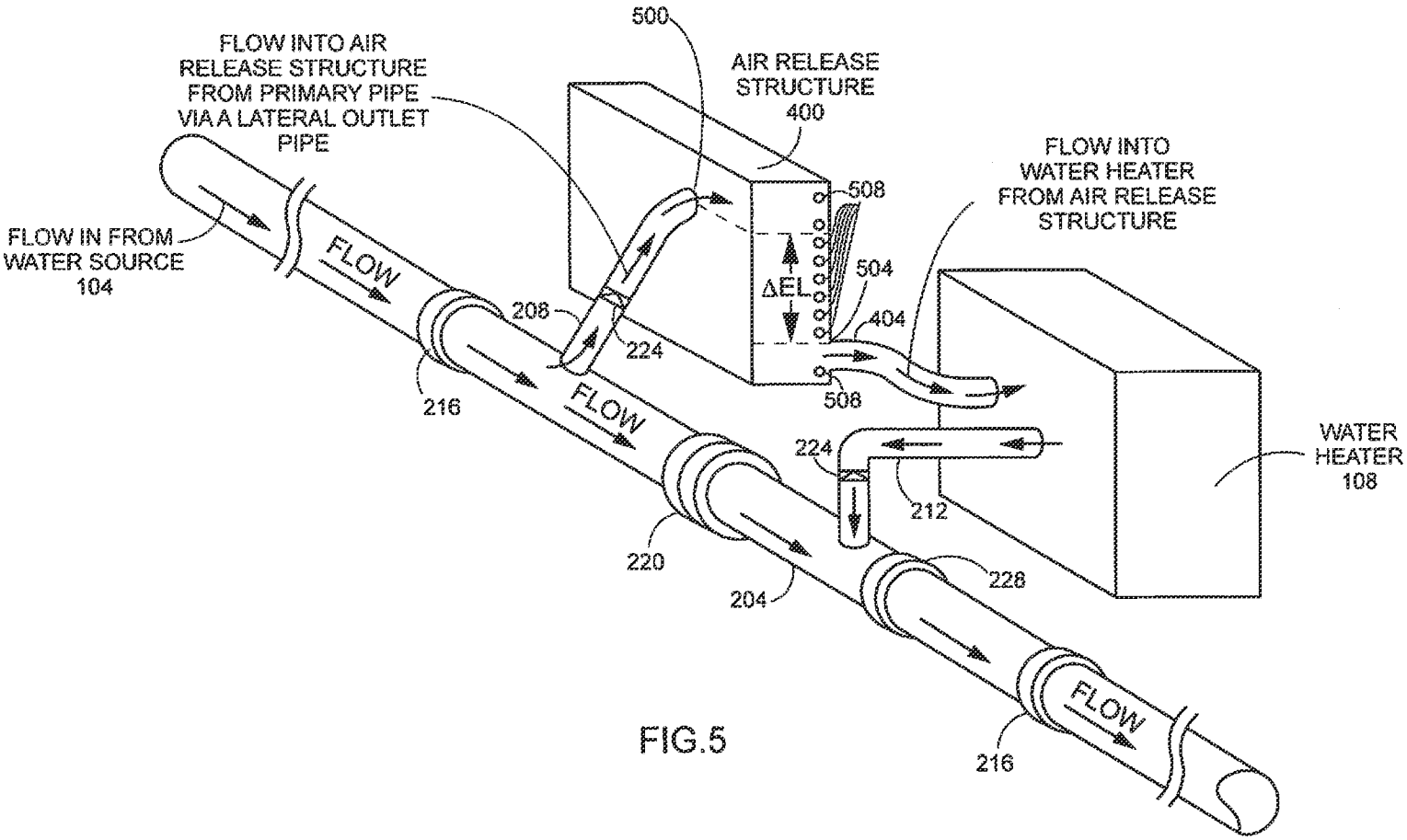
FIG. 5 is a schematic of an embodiment of the air release assembly associated with the system depicted in FIG. 4.

Referring now to FIG. 5, a variety of different types of water sources 104 may exist, such as water from a plurality of tanker trucks or mobile tanks As hydraulic fracturing operations begin, water is pumped from the water source 104 and into the primary pipe 204. During this process, air may be sucked into the primary pipe 204 because the water level within a given tank is drawn down below the level of the water outlet from the tank. An air release structure 400, in accordance with one or more embodiments described herein, serves to allow the air to escape from a portion of the flow in the primary pipe 204 before it is heated in one or more water heaters 108, such as truck-mounted water heaters 108. More specifically, a lateral outlet pipe 208 provides for a portion of the flow within the primary pipe 204 to be conveyed to the air release structure 400. In at least one embodiment, the air release structure 400 comprises a mobile tank, such as an integrated trailer-mounted tank that can be pulled by a semi-trailer truck.

In at least one embodiment, the lateral outlet pipe 208 enters the air release structure 400 at a first elevation 500. In at least one embodiment, a transfer pipe (or hose) 404 is situated between the air release structure 400 and a water heater 108. Water leaving the air release structure 400 exits at a second elevation 504, wherein first elevation 500 is higher than second elevation 504. The difference between first elevation 500 and second elevation 504 is a change in elevation ΔEL. The difference in elevation helps ensure that the air is allowed to vent from the flow before the water is conveyed to the water heater 108 via the transfer pipe 404. After water is heated in the water heater 108, the heated water is returned to the primary pipe 204 by way of a lateral inlet pipe 212.

Still referring to FIG. 5, in at least one embodiment, the system utilizing one or more air release structures 400 as described above may further include a primary flow control mechanism 220 that allows the overall rate of flow through the primary pipe 204 to be adjusted. Although not shown in FIG. 5, in at least one embodiment, the air release structure 400 may be used with one or more water heaters 108, wherein the associated piping does not include a primary flow control mechanism 220 situated between a lateral outlet pipe 208 and a lateral inlet pipe 212.

Still referring to FIG. 5, in at least one embodiment, the system utilizing one or more air release structures 400 as described above may further include a secondary flow control mechanism 224 that allows the flow through a lateral outlet pipe 208 or a lateral inlet pipe 212 to be adjusted. Although not shown in FIG. 5, in at least one embodiment, the air release structure 400 may be used with one or more water heaters 108, wherein the associated lateral outlet and lateral inlet piping does not include one or more secondary flow control mechanisms 224.

In at least one embodiment, the air release structure 400 includes one or more water level sensors 508 for detecting a level of water within the air release structure 400. In at least one embodiment, the water level sensors 508 are in communication with a computer, wherein the computer monitors the level of water within the air release structure 400. In at least one embodiment, and using data from the one or more water level sensors 508, the computer causes a signal to be sent to one or more of a pump and a valve to adjust at least one of (a) a flow rate of water into the air release structure 400, and (b) a flow rate of water out of the air release structure 400. In at least one embodiment, the computer is located at a position that is spaced apart from at least one of the air release structure 400 and the one or more water heaters 108. In at least one embodiment, the computer is in communication with at least one of (a) a primary flow control mechanism 220, (b) a secondary flow control mechanism 224, and (c) a temperature sensor 228.

Figure 6:
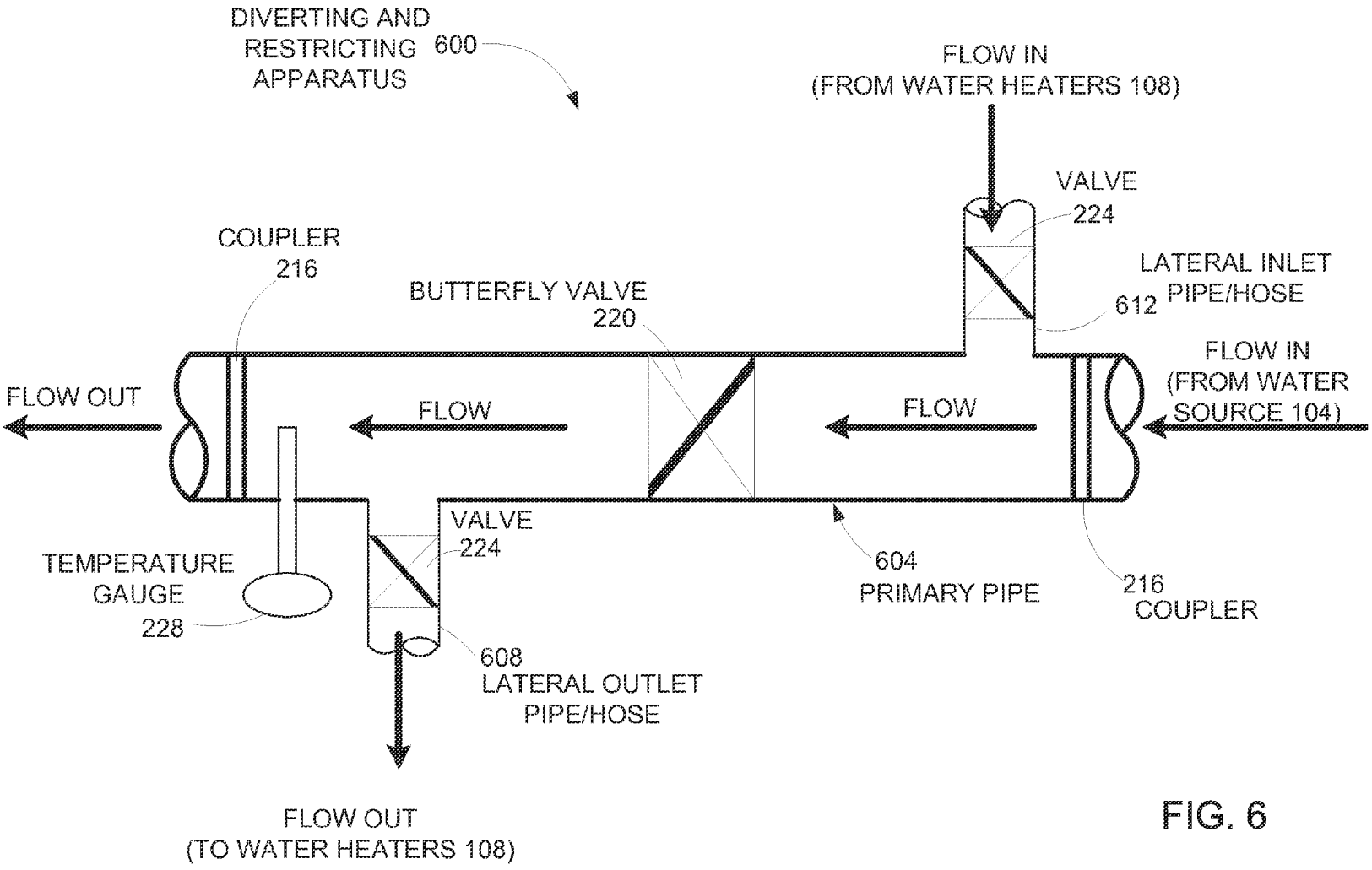
FIG. 6 is a schematic of another embodiment of a diverting and restricting apparatus portion of the system that can be used with the air release structure.

Referring now to FIG. 6, an embodiment of a diverting and restricting apparatus 600 is shown. The diverting and restricting apparatus 600 includes an upstream flange or coupler 216 for interconnecting the diverting and restricting apparatus 600 to an upstream pipe that is fluidly connected to the water source 104. The diverting and restricting apparatus 600 further includes a primary pipe 604 having at least one lateral outlet pipe 608. The lateral outlet pipe 608 provides a way of withdrawing a portion of the flow from the primary pipe 604 that can be conveyed to one or more portable heating units 108 for heating. After heating water at the one or more portable heating units 108, the heated water is returned to the primary pipe 604 via at least one lateral inlet pipe 612. In contrast to the diverting and restricting apparatus 200 described above, for diverting and restricting apparatus 600 the lateral inlet pipe 612 is located upstream of the lateral outlet pipe 608.

Figure 7:
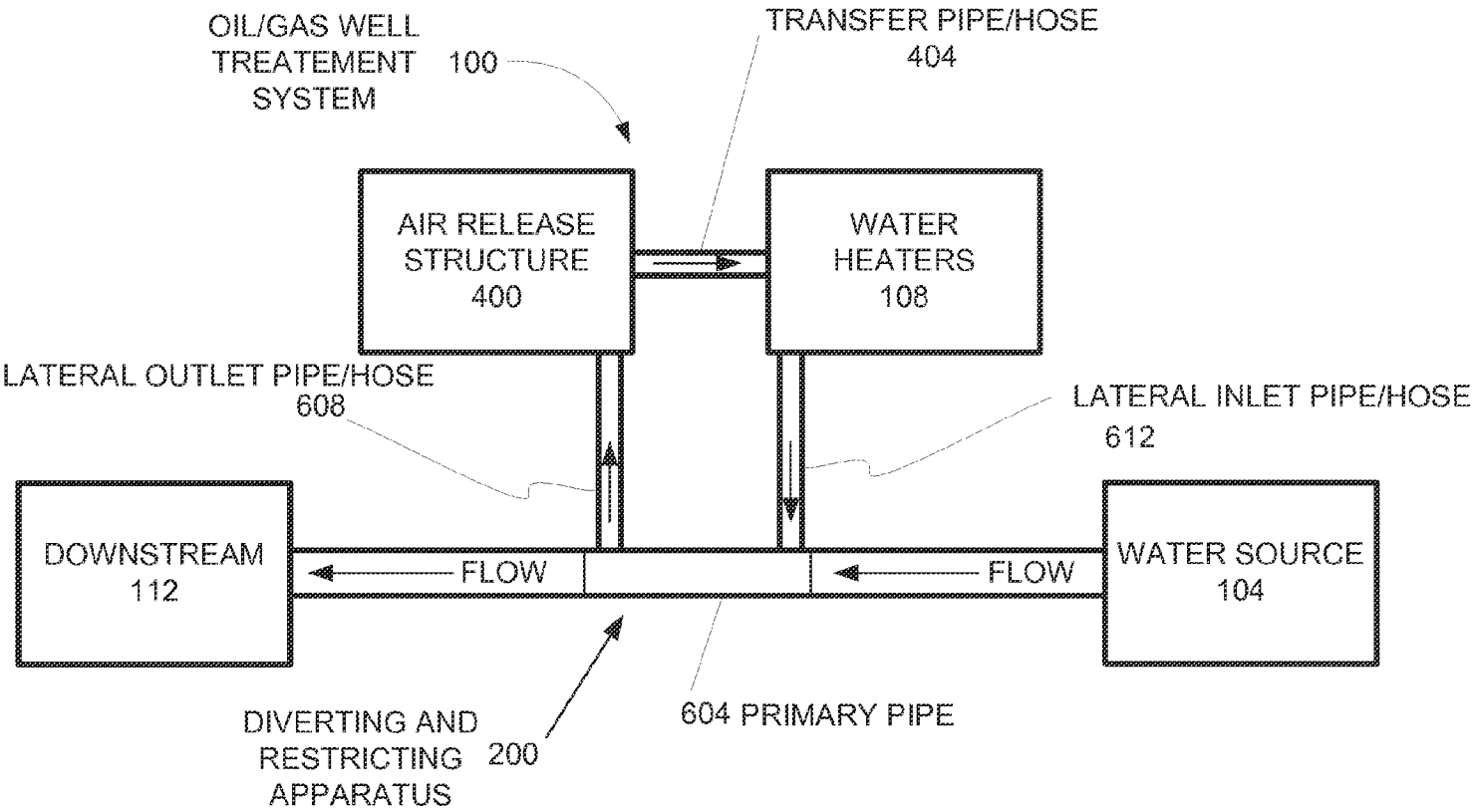
FIG. 7 is a schematic of a system in accordance with another embodiment including an air release structure.

Referring now to FIG. 7, even though the lateral inlet pipe 612 is located upstream of the lateral outlet pipe 608 per FIG. 6, air release structure 400 can be used per the configuration shown on FIG. 7. Again, it can be seen that the air release structure 400 is situated between the lateral outlet pipe 608 and the one or more water heaters 108. Therefore, the air release structure 400 enables air to be removed from that portion of the water flow that is being heated and returned to the primary pipe 604.

Figure 8:
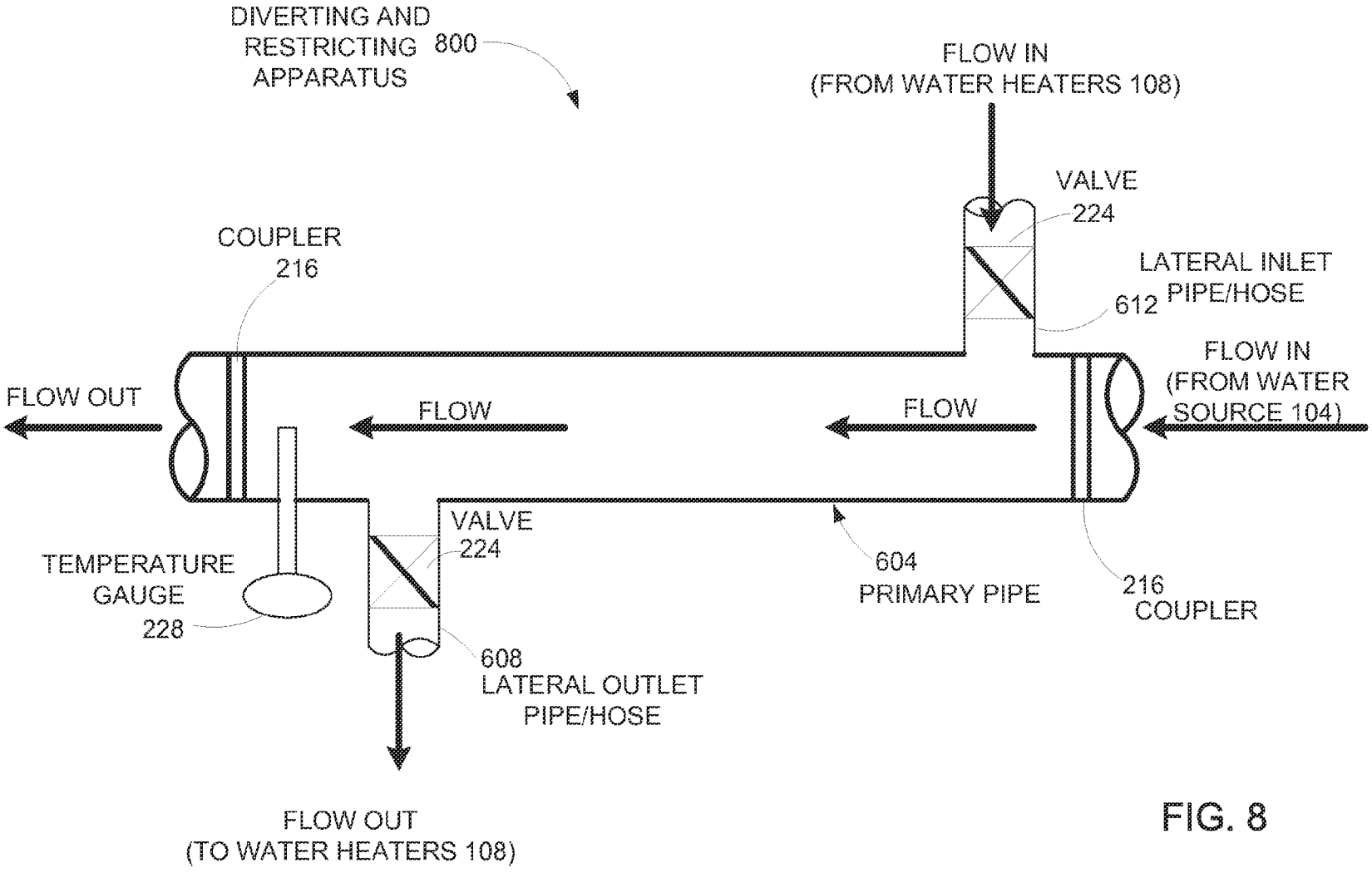
FIG. 8 is a schematic of yet another embodiment of a diverting and restricting apparatus portion of the system that can be used with the air release structure.

Referring now to FIG. 8, an air release structure 400 can be used, such as per the configuration shown on FIG. 7, for a diverting and restricting apparatus 800 that includes a primary pipe 604 without a primary flow control mechanism. Accordingly, several diverting and restricting apparatus are illustrated herein for purposes of enablement; however, it is to be understood that the air release structure can be used with these and other assemblies used as part of a water heating system associated with oil/gas well treatment systems.

The one or more present inventions may be embodied in other specific forms without departing from its spirit or essential characteristics. The described embodiments are to be considered in all respects only as illustrative and not restrictive. The scope of the one or more present inventions is, therefore, indicated by the appended claims rather than by the foregoing description. All changes which come within the meaning and range of equivalency of the claims are to be embraced within their scope.

The one or more present inventions, in various embodiments, includes components, methods, processes, systems and apparatus substantially as depicted and described herein, including various embodiments, subcombinations, and subsets thereof. Those of skill in the art will understand how to make and use the one or more present inventions after understanding the present disclosure.

The one or more present inventions, in various embodiments, includes providing devices and processes in the absence of items not depicted and/or described herein or in various embodiments hereof, including in the absence of such items as may have been used in previous devices or processes (e.g., for improving performance, achieving ease and/or reducing cost of implementation).

The foregoing discussion of the one or more present inventions has been presented for purposes of illustration and description. The foregoing is not intended to limit the one or more present inventions to the form or forms disclosed herein. In the foregoing Detailed Description for example, various features of the one or more present inventions are grouped together in one or more embodiments for the purpose of streamlining the disclosure. This method of disclosure is not to be interpreted as reflecting an intention that the claimed one or more present inventions requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the one or more present inventions, Moreover, though the description of the one or more present inventions has included description of one or more embodiments and certain variations and modifications, other variations and modifications are within the scope of the one or more present inventions e.g., as may be within the skill and knowledge of those in the art, after understanding the present disclosure). It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An assembly adapted for use with an oil/gas well treatment system that includes a water source and upstream piping carrying a primary flow of water from the water source, the oil/gas well treatment system further including one or more water heaters for heating a partial flow from the primary flow of water, the oil/gas well treatment system further including downstream piping, the assembly comprising:

a primary pipe for coupling to the upstream piping and the downstream piping;

a lateral outlet pipe connected to the primary pipe for conveying the partial flow from the primary flow of water from the primary pipe;

an air release structure connected to the lateral outlet pipe, the air release structure adapted to release at least some air within the partial flow from the primary flow of water;

a transfer pipe located between the air release structure and the one or more water heaters, the transfer pipe adapted for conveying water between the air release structure and the one or more water heaters; and a lateral inlet pipe connected to the primary pipe, the lateral inlet pipe interconnected to the air release structure via the one or more water heaters and the transfer pipe, wherein an inlet for the lateral outlet pipe entering the air release structure is located at a higher elevation than an outlet for the transfer pipe exiting the air release structure.

2. An assembly adapted for use with an oil/gas well treatment system that includes a water source and upstream piping carrying a primary flow of water from the water source, the oil/gas well treatment system further including one or more water heaters for heating a partial flow from the primary flow of water, the oil/gas well treatment system further including downstream piping, the assembly comprising:

a primary pipe for coupling to the upstream piping and the downstream piping and further comprising a valve situated within the primary pipe and located between the lateral outlet pipe and the lateral inlet pipe;

a lateral outlet pipe connected to the primary pipe for conveying the partial flow from the primary flow of water from the primary pipe;

an air release structure connected to the lateral outlet pipe, the air release structure adapted to release at least some air within the partial flow from the primary flow of water;

a transfer pipe located between the air release structure and the one or more water heaters, the transfer pipe adapted for conveying water between the air release structure and the one or more water heaters; and a lateral inlet pipe connected to the primary pipe, the lateral inlet pipe interconnected to the air release structure via the one or more water heaters and the transfer pipe.

3. The assembly of claim 2, wherein the valve comprises a butterfly valve.

4. The assembly of claim 2, wherein the valve is manually actuated.

5. The assembly of claim 2, wherein the valve is electronically actuated.

6. The assembly of claim 5, further comprising a temperature gauge operatively associated with the primary pipe for sensing a temperature within the primary pipe.

7. The assembly of claim 6, wherein the valve is electronically actuated.

8. The assembly of claim 7, wherein a computer monitors readings from the temperature gauge and adjusts the valve.

9. The assembly of claim 2, further comprising at least one secondary valve operatively associated with at least one of the lateral outlet pipe and the lateral inlet pipe.

10. The assembly of claim 9, wherein the at least one secondary valve comprises a butterfly valve.

11. The assembly of claim 9, wherein the at least one secondary valve is manually actuated.

12. The assembly of claim 9, wherein the at least one secondary valve is electronically actuated.

13. The assembly of claim 12, further comprising a temperature gauge operatively associated with the primary pipe for sensing a temperature within the primary pipe.

14. The assembly of claim 13, wherein a computer monitors readings from the temperature gauge and adjusts the at least one secondary valve.

15. The assembly of claim 2, further comprising a temperature gauge downstream of the primary pipe, wherein the temperature gauge is operatively associated with a liquid storage member.

16. The assembly of claim 15, wherein the liquid storage member comprises one or more of a tank, container, pond, and liquid holding apparatus.

* * * * *